US010089833B2

(12) United States Patent
Meyer

(10) Patent No.: US 10,089,833 B2
(45) Date of Patent: Oct. 2, 2018

(54) ELECTRONIC GAMING MACHINE AND GAMING METHOD

(71) Applicant: AINSWORTH GAME TECHNOLOGY LIMITED, Newington, NSW (AU)

(72) Inventor: Jason Meyer, Newington (AU)

(73) Assignee: Ainsworth Game Technology Limited, Newington, NSW (AU)

( * ) Notice: Subject to any disclaimer, the term of this patent is extended or adjusted under 35 U.S.C. 154(b) by 777 days.

(21) Appl. No.: 14/274,450

(22) Filed: May 9, 2014

(65) Prior Publication Data

US 2014/0335934 A1 Nov. 13, 2014

(30) Foreign Application Priority Data

May 10, 2013 (AU) ..... 2013901662
Aug. 7, 2013 (AU) ..... 2013902958

(51) Int. Cl.
*G07F 17/34* (2006.01)
*G07F 17/32* (2006.01)

(52) U.S. Cl.
CPC ..... *G07F 17/34* (2013.01); *G07F 17/3267* (2013.01)

(58) Field of Classification Search
None
See application file for complete search history.

(56) References Cited

U.S. PATENT DOCUMENTS

| | | | | |
|---|---|---|---|---|
| 9,087,438 | B2 * | 7/2015 | Aponte | G07F 17/34 |
| 9,093,307 | B2 * | 7/2015 | Aoki | H01L 22/10 |
| 2003/0060266 | A1 * | 3/2003 | Baerlocher | G07F 17/32 463/20 |
| 2007/0021187 | A1 * | 1/2007 | Gauselmann | G07F 17/3265 463/20 |
| 2009/0124325 | A1 | 5/2009 | Wadleigh et al. | |
| 2014/0031100 | A1 * | 1/2014 | Gomez | G07F 17/34 463/20 |

* cited by examiner

*Primary Examiner* — Robert T Clarke, Jr.
(74) *Attorney, Agent, or Firm* — Cook Alex Ltd.

(57) ABSTRACT

The invention provides an electronic gaming machine (1) comprising an electronic game controller (4) and a display (7) that shows a first game array (11) and two or more second game arrays (30). Each second game array (30) is associated with a respective designated predetermined position (33) of a plurality of predetermined positions (13) on the first game array (11). The appearance of one or more special symbols (25) in one or more of the designated predetermined positions (33) causes the electronic game controller (4) to make each second game array (30) associated with the one or more designated predetermined positions (33) available to the player for play simultaneously with the first game array (11).

28 Claims, 9 Drawing Sheets

ELECTRONIC GAMING MACHINE AND GAMING METHOD

FIELD OF THE INVENTION

The present invention relates to an electronic gaming machine and in a particular an electronic gaming machine using a base game and a feature game. The invention has been developed primarily for use as an electronic gaming machine and will be described hereinafter by reference to this application.

BACKGROUND OF THE INVENTION

The following discussion of the prior art is intended to present the invention in an appropriate technical context and allow its advantages to be properly appreciated. Unless clearly indicated to the contrary, however, reference to any prior art in this specification should not be construed as an express or implied admission that such art is widely known or forms part of common general knowledge in the field.

Conventional gaming machines typically involve awarding prizes to a player according to predetermined combinations of game symbols that appear on an array of game squares displayed on a screen, typically organized into three rows and five columns (a 5×3 array). Other arrays, such as a 3×3 or 4×3, may be used. Each gaming machine randomly selects the game symbols that appear on the array, each column of the array being a "reel".

In an electronic gaming machine, the mechanical reels are replaced with video images of the reels, which are displayed on a video display screen. The electronic gaming machine has an internal electronic game controller, typically a computer, that controls the display of images on the video display screen so that the reels are visibly spun on the screen to simulate a physical reel of a traditional gaming machine. Electronic gaming machines are also more versatile in presenting game information, varying the probabilities for a player to win a prize and varying the type of game that is played.

In an electronic gaming machine, the mechanical reels are replaced with video images of the reels, which are displayed on a video display screen. The electronic gaming machine has an internal electronic game controller, typically a computer, that controls the display of images on the video display screen so that the reels are visibly spun on the screen to simulate a physical reel of a traditional gaming machine. Electronic gaming machines are also more versatile in presenting game information, varying the probabilities for a player to win a prize and varying the type of game that is played. Conventionally, such reel-type games comprise a main or base game offered by the electronic gaming machine.

Bonus or "feature" games may be provided by an electronic gaming machine in addition to the base or main game. Typically feature games use the same set of reels as the main game and are limited to a set of free games operated under a single set of rules that may be slightly modified from the base game. Once the free feature games have been played, the electronic gaming machine resets itself and returns the player back to the base game. This standard structure to game play limits the variation in the play of the electronic gaming machine. Consequently, it is difficult to retain player interest because there is no apparent incentive for the player to continue playing the same electronic gaming machine. Also, it is difficult to retain player interest since there is little differentiation between gaming machines in terms of the main and feature games that are played.

It is an object of the present invention to overcome or substantially ameliorate one or more of the disadvantages of prior art, or at least to provide a useful alternative.

It is an object of the invention in at least one preferred form to provide an electronic gaming machine and a method for controlling an electronic gaming machine that encourages player interest.

SUMMARY OF THE INVENTION

According to a first aspect of the invention, there is provided an electronic gaming machine comprising:

a display for displaying a plurality of game arrays, and where predetermined winning combinations of randomly selected game symbols in each game array award prizes to a player, and an electronic game controller for controlling the display of game symbols on said display, wherein said plurality of game arrays comprise a first game array and two or more second game arrays, said first game array and said second game arrays each comprising a plurality of predetermined positions for displaying said randomly selected game symbols, each said second game array being associated with a respective designated predetermined position of said predetermined positions on said first game array, said electronic game controller determining the appearance of one or more special symbols in said predetermined positions on said first game array, and the appearance of at least one special symbol in one or more of said designated predetermined positions in a play of a game on said first game array causes said electronic game controller to make each second game array associated with said one or more designated predetermined positions available to said player for play simultaneously with said first game array.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Furthermore, as used herein and unless otherwise specified, the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Preferably, wherein said second game arrays are arranged in a group such that the position of each said second game array in said group corresponds to the location of its respective associated designated predetermined position on said first game array.

Preferably, wherein the number of said second game arrays is less than the number of said predetermined positions on said first game array.

Preferably, each said available second game array is playable simultaneously with said first game array for said play. Alternatively or additionally, it is preferred that each said available second game array is playable simultaneously with said first game array for one or more subsequent plays of said game. More preferably, said at least one special symbol occupies said one or more designated predetermined positions for said subsequent plays.

Preferably, said at least one special symbol confers a gaming enhancing element on said first game array. Alternatively or additionally, it is preferred that said at least one special symbol confers a gaming enhancing element on each said available second game array.

Preferably, said gaming enhancing element increases the value of any prizes awarded by said first game array. Alternatively or additionally, said gaming enhancing element increases the value of any prizes awarded by each said available second game array. More preferably, said gaming enhancing element comprises a numerical value and said increase being associated with said numerical value. In one preferred form, said increase comprises multiplying the value of any prizes by said numerical value. In a particularly preferred form, said numerical value is equal to the number of special symbols appearing in said designated predetermined positions on said first game array.

Preferably, said first game array comprises an array of rows and columns. More preferably, said designated predetermined positions are arranged as a sub-array of said first game array, said sub-array comprising rows and/or columns of said designated predetermined positions. In one preferred form, said rows and/or columns of said sub-array are different to the rows and/or columns of the remaining part of said first game array. In a further preferred form, said sub-array comprises four rows and three columns. In yet another preferred form, said remaining part comprises three rows and two columns.

Preferably, said second game arrays each comprise an array of rows and columns. Alternatively, said second game arrays each comprise a single predetermined position. In this alternative form, game enhancing symbols appear in said second game arrays to award one or more prize enhancing elements.

Preferably, the change in said second game arrays from being unavailable to available is indicated on the display. More preferably, said change is indicated by removing said translucent image from said unavailable second game arrays when they become said available second game arrays.

Preferably, said electronic game controller causes each special symbol previously displayed in a preceding play of said primary game to be displayed in the same designated predetermined position for at least one subsequent play of said primary game.

Preferably, said electronic game controller randomly selects said one or more designated predetermined positions in which said at least one special symbol appears.

Preferably, said game comprises a feature game. Alternatively, said game comprises a base game. In a further alternative, said game comprises a base game and a feature game, wherein said play of said game is a play of said base game on said first game array and said subsequent plays comprise plays of said feature game on said first game array and each said available second game array. In yet another alternative, said game comprises a base game and a feature game, wherein a trigger event in said base game causes or triggers the appearance of said at least one special symbol in said feature game, said play and said subsequent plays comprising plays of said feature game.

Preferably, said at least one special symbol appears in response to a trigger event in said game. More preferably, said trigger event is a randomly number generated by said electronic game controller. Alternatively, said trigger event is the appearance of one or more trigger symbols on said first game array. In this embodiment, said trigger symbols appear in a preceding play to said play.

Preferably, said predetermined positions are arranged in said first game array to define a shape. Likewise, it is preferred that said predetermined positions of said second game arrays are such that they each define a shape. In one preferred form, said shape is rectangular for said first game array and/or said second game arrays. However, it will be appreciated that other shapes can be formed, including square, triangular or other polygonal shapes, as well as irregular shapes such as a shape having uneven rows and/or columns.

Preferably, said special symbols comprise at least one of said game symbols, a substitute symbol, a symbol that reveals another game symbol and a new game symbol.

Preferably, as part of said game, said columns visually move to simulate rotation thereof. More preferably, said play and said subsequent plays each comprise from when said columns begin to visually move to when said columns stop visually moving. Alternatively, said predetermined positions individually move visually to simulate rotation of each said predetermined position.

Preferably, said game comprises a jackpot prize. More preferably, said jackpot prize comprises a mystery jackpot. In one preferred form, said game shares said jackpot prize with another game played on said electronic gaming machine. In another preferred form, said game shares said jackpot prize with another game played on a different electronic gaming machine to said electronic gaming machine.

Preferably, said first game array and said second game arrays have the same shape or are of the same type. Alternatively, said first game array and said second game arrays are arranged in differently shaped arrays to each other. This also includes said second game arrays have different shapes to each other. The shapes of said first game array and said second game arrays are preferably rectangular, circular, triangular, oval, semi-circular or other polygonal shape. Furthermore, said first game array and said second game arrays may have irregular shapes.

Preferably, said electronic game controller causes the display of said first game array and said second game arrays during play of said first game array, said second game arrays being unavailable until activated by the appearance of said at least one special symbol in said one or more designated predetermined positions. More preferably, said unavailable second game arrays operate simultaneously with said first game array and any available second game arrays but are not available for said player to play. In one preferred form, said unavailable second game arrays are partially obscured by a translucent image.

Preferably, the electronic gaming machine comprises a mobile electronic gaming device. More preferably, said mobile electronic gaming device comprises a handheld electronic device. Alternatively, said electronic gaming machine comprises a computer. More preferably, said computer is connected to a communication network.

According to a second aspect of the invention, there is provided a gaming method for an electronic gaming machine comprising a display and an electronic game controller, the method comprising the steps of:

controllably displaying a plurality of game arrays on said display, said game arrays comprising a first game array and two or more second game arrays, said first game array and said second game arrays each comprising a plurality of predetermined positions for displaying randomly selected game symbols;

controllably displaying said randomly selected game symbols in said predetermined game positions on said game arrays, where predetermined winning combinations of said randomly selected game symbols in each game array award prizes to a player, and in response to the appearance of at least one special symbol in one or more of said designated predetermined positions in a play of a game on said first game array, causing said each second game array associated with said one or more designated predetermined positions to become available to said player for play simultaneously with said first game array.

Preferably, said method further comprises arranging said second game arrays are arranged into a group such that the position of each said second game array in said group corresponds to the location of its respective associated designated predetermined position on said first game array.

Preferably, said method further comprises displaying a number of said second game arrays less than the number of said predetermined positions on said first game array.

Preferably, said causing step comprises making each said available second game array playable simultaneously with said first game array for said play. Alternatively or additionally, it is preferred that said causing step comprises making each said available second game array playable simultaneously with said first game array for one or more subsequent plays of said game.

Preferably, said method further comprises displaying said at least one special symbol in said one or more designated predetermined positions for said subsequent plays.

Preferably, said method further comprises conferring a gaming enhancing element on said first game array in response to said appearance of said at least one special symbol. Alternatively or additionally, it is preferred that said method further comprises conferring a gaming enhancing element on each said available second game array in response to said appearance of said at least one special symbol.

Preferably, said conferring step comprises increasing the value of any prizes awarded by said first game array. Alternatively or additionally, said conferring step comprises increasing the value of any prizes awarded by each said available second game array. More preferably, said gaming enhancing element comprises a numerical value and said increasing step is associated with said numerical value. In one preferred form, said increasing step comprises multiplying the value of any prizes by said numerical value. In a particularly preferred form, said numerical value is equal to the number of special symbols appearing in said designated predetermined positions on said first game array.

Preferably, said first game array comprises rows and/or columns of said predetermined positions. More preferably, said method further comprises arranging said designated predetermined positions into a sub-array of said first game array, said sub-array comprising rows and/or columns of said designated predetermined positions. In one preferred form, said arranging step comprises arranging said rows and/or columns of said sub-group to be different to the rows and/or columns of the remaining parts of said first game array. In a further preferred form, said sub-group comprises four rows and three columns. In another preferred form, said remaining part comprises three rows and two columns.

Preferably, said method further comprises randomly selecting said one or more designated predetermined positions to display said at least one special symbol.

Preferably, said method further comprises displaying each special symbol previously displayed in a preceding play the same predetermined game position for at least one subsequent play.

Preferably, said game comprises a feature game. Alternatively, said game comprises a base game. In a further alternative, said game comprises a base game and a feature game, said play comprising a play of said base game on said first game array and said subsequent plays comprise plays of said feature game on said first game array and each said available second game array. In yet another alternative, said game comprises a base game and a feature game, said method further comprising causing a trigger event in said base game and triggering said appearance of said at least one special symbol in said feature game in response to said trigger event, wherein said play and said subsequent plays comprise plays of said feature game.

Preferably, said method further comprises triggering said appearance of said first special symbol in response to a trigger event in said game. More preferably, said method further comprises causing said trigger event in a preceding play to said play.

Preferably, said method further comprising providing said special symbols as at least one of said game symbols, a substitute symbol, a symbol that reveals another game symbol and a new game symbol.

Preferably, said method further comprises the step of visually moving said columns as part of said game to simulate rotation of said columns and wherein said play comprises from when said columns begin to visually move to when said columns stop visually moving.

Preferably, the method further comprises the step of providing a jackpot prize for said game. More preferably, said jackpot prize comprises a mystery jackpot. In one preferred form, said method comprises the steps of providing another game on said electronic gaming machine and sharing said jackpot prize between said game and said another game. In another preferred form, said method comprises the steps of sharing said jackpot prize between said game and a game playable on another electronic gaming machine.

The method also preferably has the preferred features of the first aspect of the invention not otherwise stated above.

According to a third aspect of the invention, there is provided a computer system comprising a central processing unit configured for communication with an electronic gaming machine, wherein said computer system is configured to perform the method of the second aspect of the invention.

According to a fourth aspect of the invention, there is provided a computer program configured to perform the method of the second aspect of the invention.

According to a fifth aspect of the invention, there is provided a non-transitory carrier medium carrying computer executable code that, when executed on a central processing unit configured for communication with an electronic gaming machine, causes the central processing unit to perform the method of the second aspect of the invention.

BRIEF DESCRIPTION OF THE DRAWINGS

Preferred embodiments of the invention will now be described, by way of example only, with reference to the accompanying drawings in which.

PREFERRED EMBODIMENTS OF THE INVENTION

Figure 1:
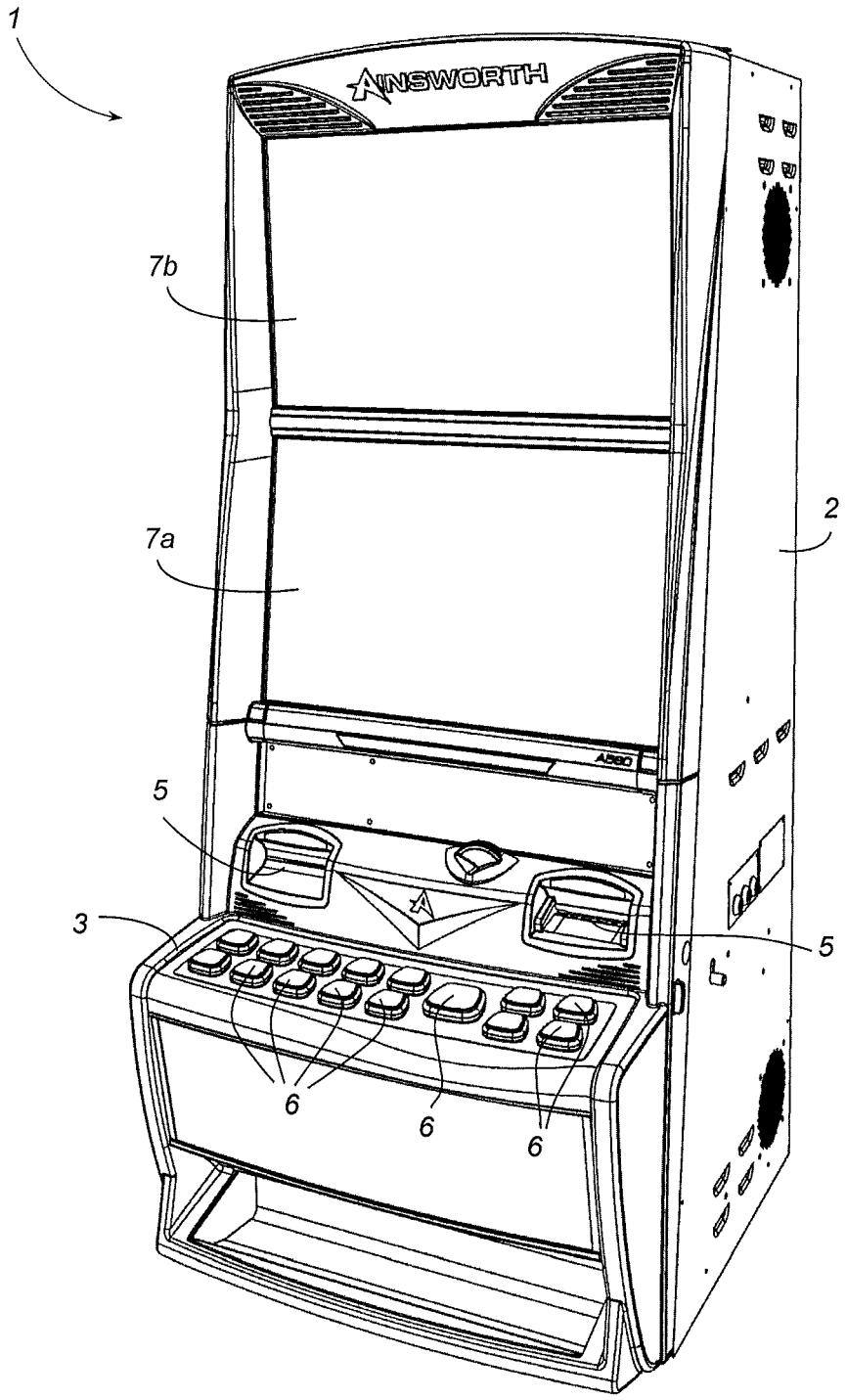
FIG. 1 is a perspective view of an electronic gaming machine according to an embodiment of the invention.
Figure 2:
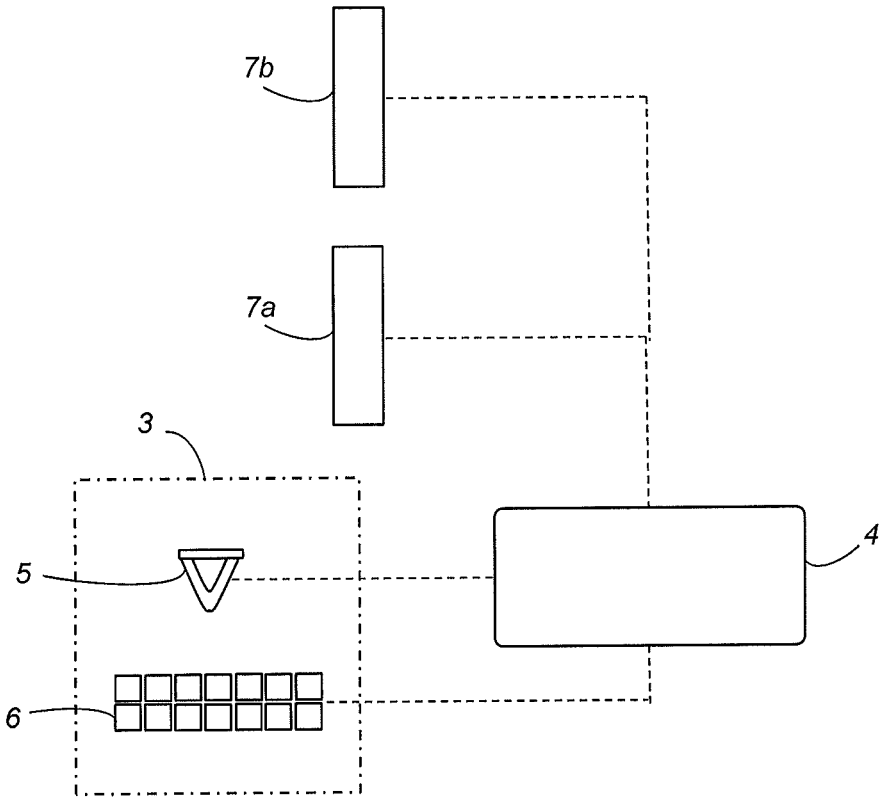
FIG. 2 is a schematic drawing of an electronic game controller for the electronic gaming machine of FIG. 1.

Referring to FIG. 1, an electronic gaming machine 1 according to a first embodiment of the invention includes a cabinet 2, a console 3 and an internal electronic game controller 4. The console 3 has various input devices including vending slots 5 for receiving monetary bets and a plurality of buttons 6 for actuation by a player. The electronic game controller 4 is generally in the form of a central processing unit, such as a computer, and is in electronic communication with a display 7 in the form of two video display screens 7*a* and 7*b*, as well as various input devices on the console 3. It is also appreciated that a person skilled in the art would readily understand the location and use of the electronic game controller 4 in the electronic gaming machine 1.

Figure 3:
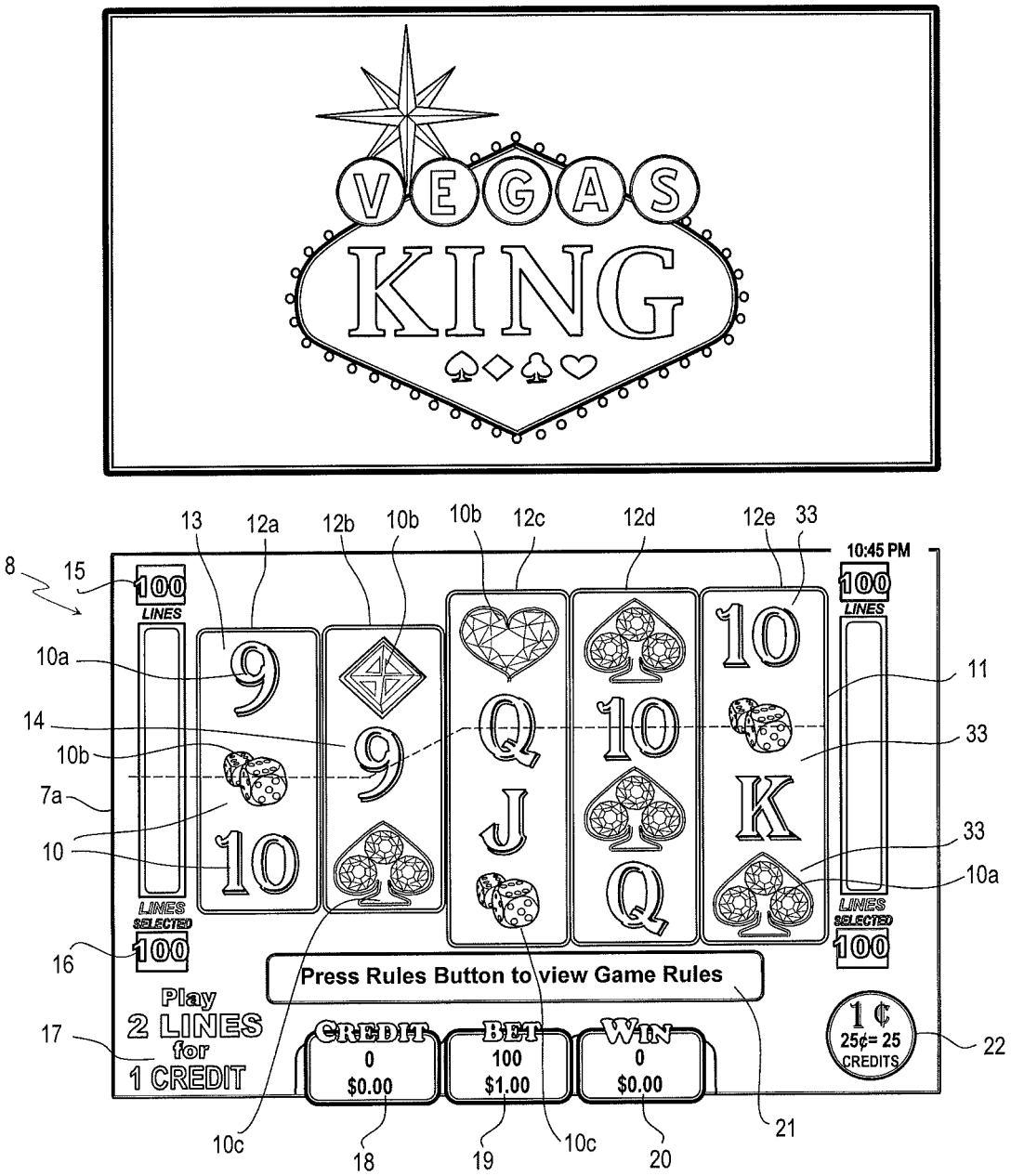
FIG. 3 is a schematic drawing illustrating a base game displayed on the electronic gaming machine of FIG. 1.

The electronic game controller 4 is programmed to provide a game in the form of a base game 8 (as best shown in FIG. 3) and a feature game 9 (as best shown in FIGS. 4 to 7) on the electronic gaming machine 1 for play by a player. The base game 8 has game symbols 10 arranged into a first, primary or main array 11 in the form of five columns or "reels" 12, as best shown in FIG. 3. While the primary array 11 is arranged with five reels 12, it will be appreciated by one skilled in the art that other array formats could be used, such as the industry standard 5×3, 3×3, 4×3, 5×5, 4×4, etc.

The primary array 11 of the base game 8 defines predetermined positions in the form of "squares" or cells 13, in which the game symbols 10 appear. The primary array 11 is arranged so that a player can select one or more predetermined "pay lines" 14 defined around the array, which correspond to combinations of the positions or cells 13. The pay lines 14 correspond to the lines selected by the player and generally comprise at least one game position 12 from each reel 12. The number of pay lines 14 that can be selected by the player depends on the amount of the monetary bet for playing a game on the primary array 11. In the base game 8, predetermined winning combinations of randomly selected game symbols 10 result in the award of prizes to the player. In the feature game 9, predetermined winning combinations of randomly selected game symbols 10 also result in the award of prizes to the player, usually of an enhanced value compared to the prizes awarded in the base game 8.

The game symbols 10 can include a mixture of picture symbols (such as animal symbols or playing card symbols) scatter symbols, substitute or wild card symbols and trigger symbols to trigger the feature game 9 or other game enhancing element like a jackpot. Those skilled in the art will readily understand that a substitute symbol is able to act as any other game symbol, and hence is also known as a "wild card" symbol. Likewise, those skilled in the art will readily understand that a scatter symbol is a symbol that, when a predetermined number of the trigger symbols appear on the reels 12, triggers a game event or confers an award without having to appear on a player-selected pay line 14 is a symbol that triggers a game event or confers an award without having to appear on the same player-selected pay line 14. In this embodiment, the game symbols 10 include playing card symbols 10*a*, card suite symbols 10*b*, dice symbols 10*c* and a substitute or wild card symbol in the form of crown symbols 10*d*. The electronic game controller 4 randomly determines the appearance of the game symbols 10 on the array 11.

The lower video screen 7*a* may also display other standard game information including the number of pay lines available 15, the number of player-selected pay lines 16, the amount of credits per line 17, the amount of player credits 18, the amount of the current bet wagered by the player 19, the amount of wins by the player 20, a message area 21 and a current denomination button 22 indicating the currently selected base bet denomination. The upper video screen 7*b* displays the name of the game, "Vegas Kings"™, currently playable on the electronic gaming machine 1.

The player initially makes a bet using vending slots 5 initiate play of the electronic gaming machine 1 to build up credit to play the base game on the electronic gaming machine. For example, the player can bet or wager monetary amounts equivalent to a particular amount of credits, depending on the bet denomination selected for the base game. Also, the player can make any additional side bets or ante-bets during play of the base game once the game has commenced to access additional features in the game, such as increasing the number of winning combinations in the game.

Typically, electronic gaming machines offer a number of preset bet options that the player can make, and these bet options can vary depending on the game or games offered on the electronic gaming machine. For example, a game on an electronic gaming machine may provide bet options of 1 credit, 2 credits, 5 credits and 10 credits per player-selected pay line 14. In another example, the player may bet 1 credit, 2 credits, 5 credits and 10 credits for a preset group or combination of pay lines 14, such as a group of 5 pay lines, 10 pay lines, 20 pay lines, etc. The electronic gaming machine 1 also offers a variety of bet denominations of 1¢, 2¢, 5¢ and 10¢ for the base game 8.

Typically, the electronic gaming machine has a default bet denomination, which is usually the bet denomination that was previously used in the preceding play of the base game 8. For example, if a person had played the base game 8 with a bet denomination of 5¢, then this would be the default bet denomination for the player when he or she commences play of the game. Where the electronic gaming machine has not yet been played or has been started up, the default bet denomination is initially selected by the electronic game controller 4. The default bet denomination can be randomly selected or chosen according to a predetermined order. Typically, the electronic game controller 4 will select the bet denomination with the lowest value that is available for the base game 8, which would be the 1¢ bet denomination for this embodiment. The player may change the bet denomination at any time in the base game 8 by touching the denomination button before or after the reels 12 have spun.

The electronic game controller 4 then causes the reels 12 to appear to visibly rotate or "spin" in a linear path, typically in a downward vertical direction, and randomly display the game symbols 10 in each cell 13 for each play of the base game 8. After the reels 12 stop spinning, the electronic game controller 4 determines whether there are any predetermined winning combinations of the game symbols 10 appearing in any player-selected pay lines 14, such as a two of a kind, three of a kind, four of a kind or five of a kind for all the game symbols 10 and other combinations of a "full house", "straight" or "flush" for the playing card game symbols 10*a*. It will be appreciated that other winning combinations of game symbols 10 can also be provided. If so, the gaming machine 1 enters a winning game state and awards a prize according to the displayed predetermined winning combination.

Figure 5:
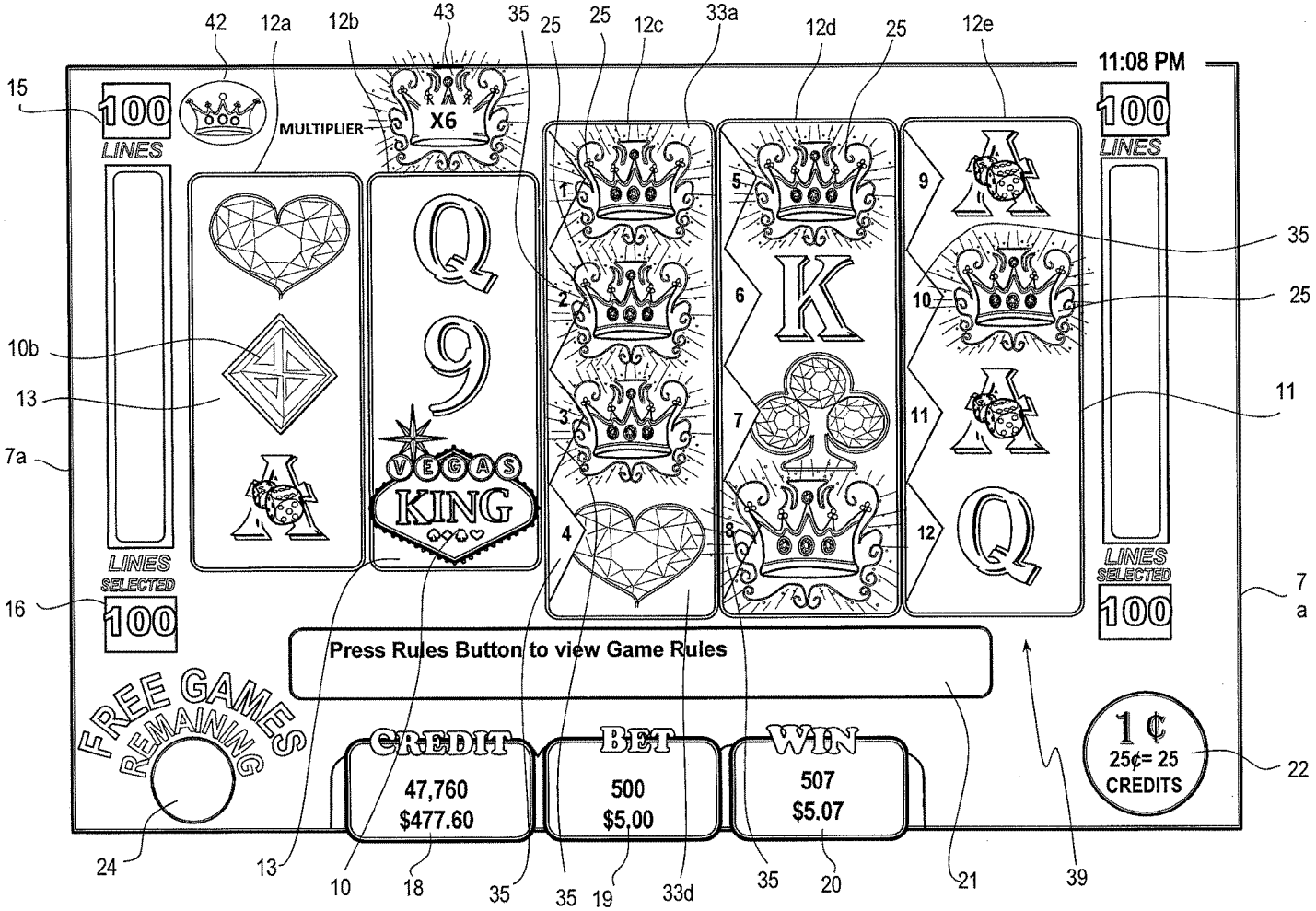

In response to a trigger event in the base game 8, the electronic game controller 4 causes the display of the feature game 9 on the display screen 7. In this embodiment, the trigger event is the appearance of three trigger or scatter symbols in the form of "neon crown" symbols 25 on the array 11 in any of the cells 13, as best shown in FIG. 5.

Figure 4:
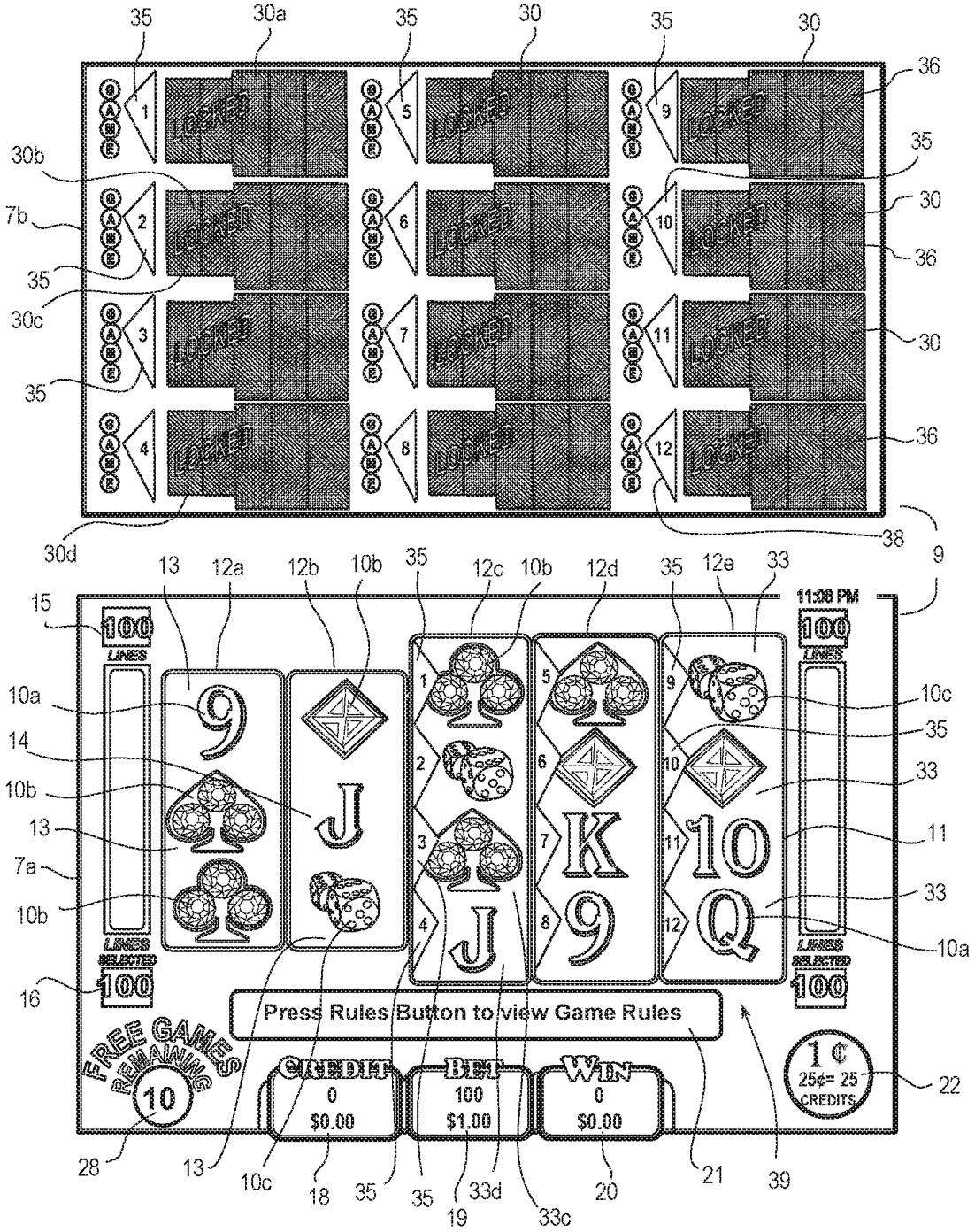
FIGS. 4 to 8 are schematic drawings illustrating various embodiments of a feature game for the base game of FIG. 3.

The feature game 9 is displayed in both video screens 7*a* and 7*b*, as best shown in FIGS. 4 to 7, where corresponding features have been given the same reference numerals. In this embodiment, the feature game 9 uses the same game symbols 10 as the base game 8, as well as the same primary array 11, reels 12, cells 13 and player-selectable pay lines 14 on the video screen 7*a*. In the feature game 9, ten free plays or spins of the feature game are awarded to the player without having to make an additional bet or wager. The number of free games remaining in the feature game 9 is indicated by counter 28. Typically, these free plays are commonly referred to as "free games". The feature game 9 operates in a similar manner to the base game 8, where the reels 12 visibly rotate and display randomly selected game symbols 10 in each cell 13, as best shown in FIG. 4.

In addition, the feature game 9 comprises a plurality of second game arrays 30 in the form of secondary arrays 30 that are displayed on the upper video screen 7*b*. The secondary arrays 30 essentially duplicate the primary array 11 in that each secondary array 30 has the same number of rows and columns (reels 12), uses the same game symbols 10 and involves spinning the reels 12 for each play as the primary array. These secondary game arrays 30 are associated with designated cells 33 of the primary game array 11. This association is indicated by a number 35 adjacent to each secondary array 30 and its respective designated cell 33. For example, the upper left secondary array 30*a* is denoted by the number "1" and its associated designated cell 33*a* is also denoted by the same number, as best shown in FIG. 4. The secondary arrays 30 also spin simultaneously with the primary array 11 for each free spin, but are not available to the player for play until activated. This unavailability of the secondary arrays 30 is indicated by a translucent image 36 superimposed over each secondary array to "grey out" each array so that the symbols 10 on each second array are visible but partially obscured. The word "LOCKED" 37 is also superimposed over each secondary array 30 to further indicate their unavailability to the player.

To assist the player in recognising the association or linking of each secondary array 30 with its respective designated cell 33, the secondary arrays 30 are arranged into a group so that the position of each secondary array in the group corresponds to the location of its respective designated cell 33 on the primary array 11. In this embodiment, the number of secondary arrays 30 is less than the total number of cells 13 on the primary array 11. To further highlight the association of the designated cells 33 with their secondary arrays 30, the designated cells 33 are arranged into a group or sub-array 39 of the primary array 11 to separate them from the remaining part of the primary array comprising the non-designated cells 13. This results in the sub-array 39 having four rows and three columns (being reels 12*c*, 12*d*, 12*e*), which is different to the three rows and two columns (being reels 12*a*, 12*b*) of the remaining part of the primary array 11.

In the feature game 9, the electronic game controller 4 also randomly determines whether one or more special symbols will appear in one or more of the predetermined positions or cells 13 on the array 11 of the video screen 7*a*, as best shown in FIG. 5. In this embodiment, the special symbol is the same as the trigger symbol for the feature game 9; that is, the neon crown symbol 25 is the special symbol for the feature game. The neon crown symbol 25 also acts as a substitute or wild card symbol, the same as substitute/wild card crown symbol 10*d*. This triple effect of the neon crown symbol 25 increases player interest and excitement in the game played on the electronic gaming machine 1 as there is an immediate recognition by the player that the appearance of the neon crown symbol 25 is likely to result in triggering the feature game 9, acting as a substitute symbol and activating the associated secondary arrays 30, all three of which increase the chances of the player winning a prize or a prize of enhanced or increased value.

After the reels 12 stop spinning, the electronic game controller 4 determines whether there are any neon crown symbols 25 on the array 11. If there are no neon crown symbols 25, as best shown in FIG. 4, then the electronic game controller 4 determines whether there are any predetermined winning combinations of the game symbols 10 appearing in any player-selected pay lines 14, such as "three of a kind", "four of a kind" and "five of a kind" for all the game symbols and/or other combinations of a "full house", "straight" or "flush" for the playing card symbols 10*a*. It will be appreciated that other winning combinations of game symbols 10 can also be provided. If there are any such winning combinations, the electronic game gaming machine 1 enters a winning game state and awards a prize according to the displayed predetermined winning combination(s).

Where one or more neon crown symbols 25 appear on the array 11, the electronic game controller determines whether any predetermined winning combinations of the game symbols 10 appear in any player-selected pay lines 14 as a result of the neon crown symbols 25 acting as a substitute symbol. If there are any such winning combinations, the electronic game gaming machine 1 enters a winning game state and awards a prize according to the displayed predetermined winning combination(s). This situation is shown in FIG. 5, where corresponding features have been given the same reference numerals and which illustrates an alternative embodiment of the invention.

The electronic game controller also determines whether any of the neon crown symbols 25 have appeared in any of the designated cells 33. As best shown in FIG. 5, the neon crown symbols 25 have appeared in five designated cells 55 of the sub-array 39, labelled by the numbers 35 as "games" 1, 2, 3, 5, 8 and 10. These five designated cells 33 correspond to the secondary arrays 30 also labelled with the same numbers 1, 2, 3, 5, 8 and 10 in the video screen 7*b*. Accordingly, the electronic game controller 4 activates these secondary arrays 30 for play immediately. The appearance of each neon crown symbol 25 is accompanied by suitable sounds and animation to indicate to the player that a special symbol has appeared on the sub-array 39. The change in the secondary arrays 30 from inactive to active (or from being unavailable to available) for the player to play is indicated by removing the translucent image 36 and "LOCKED" image 37 from each secondary array 30 that has become available. Again, the activation or making available of the secondary arrays 30 may be accompanied by suitable sounds and/or animation to indicate this change to the player. Thus, the player immediately accesses any winning combinations that appear on the secondary arrays 30 labelled as arrays 1, 2, 3, 5, 8 and 10.

The appearance of the neon crown symbols 25 further confers an additional game enhancing element to the feature game 9 by providing a multiplier effect to any prizes that are awarded to the player for that spin. For each neon crown symbol 25, the value of the awarded prize is multiplied by the number of neon crown symbols 25 appearing on the sub-array 39 or the primary array 11. As best shown in FIG. 5, six neon crown symbols 25 have appeared on the sub-array 39, conferring a ×6 multiplier to any prizes awarded to the player from predetermined winning combinations on the primary array 11. This multiplier effect also extends to any from predetermined winning combinations on the available secondary arrays 30. The multiplier effect conferred by the neon crown symbols 25 is indicated on the video screen 7*a* by a suitable multiplier message 42 and counter 43 adjacent the primary array 11.

Once a secondary array 30 becomes available in a spin of the feature game 9, it remains available for the remaining free spins of the feature game. Hence, the player interest and excitement is increased in the knowledge that subsequent plays or spins of the feature game 9 can activate or make available further secondary arrays 30 up to having all twelve secondary arrays available, thus increasing the probability of obtaining a predetermined winning combination of game symbols on either the primary array 11 or any of the secondary arrays 30.

Also, in this embodiment, once the neon crown symbol 25 appears on the sub-array 39, it is displayed on the same designated cell 33 for each subsequent spin or play until the end of the feature game 9 when all ten free games or plays of the feature game are finished. This provides the player certainty that any special symbols 25 which appear are retained in their displayed position for the duration of the feature game 9. Thus, there is added excitement in that the special neon crown symbols 25 accumulate in number for subsequent spins or plays, resulting in both increased chances of obtaining a winning combination on the primary array 11 and the available secondary arrays 30 and increasing the multiplier effect for the value of any prizes that are awarded.

Figure 6:
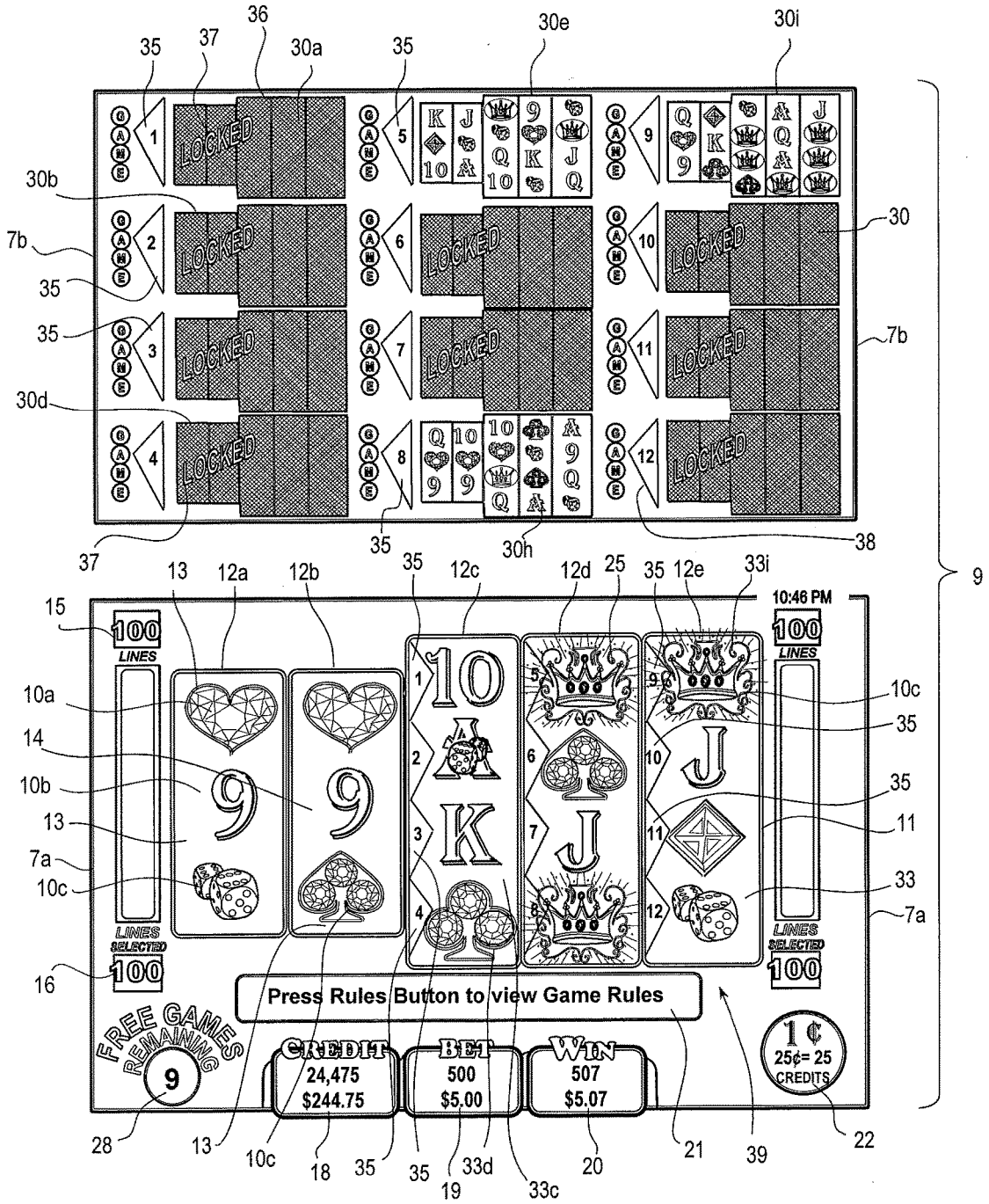

FIG. 6 shows a subsequent spin of the feature game 9 immediately following the spin of FIG. 4, where corresponding features have been given the same reference numerals. In this embodiment, three neon crown symbols 25 have appeared in designated cells 33*e*, 33*h* and 33*i* on the sub-array 39, causing their associated secondary arrays 30*e*, 30*h* and 30*i* to become available or active for play simultaneously with the primary array 11. The player accesses the results of the spins of the available secondary arrays 30*e*, 30*h* and 30*i* with the primary array 11 without having to wait for the next spin or play. As described above in relation to FIG. 5, the available secondary arrays 30*e*, 30*h* and 30*i* remain available and the neon crown symbol 25 is displayed in designated cell 33*e*, 33*h* and 33*i* for subsequent plays or spins until the end of the feature game 9. The remaining secondary arrays 30 remain unavailable and are indicated as such to the player by the translucent image 36 and LOCKED message 37 on each unavailable secondary array.

Figure 7:
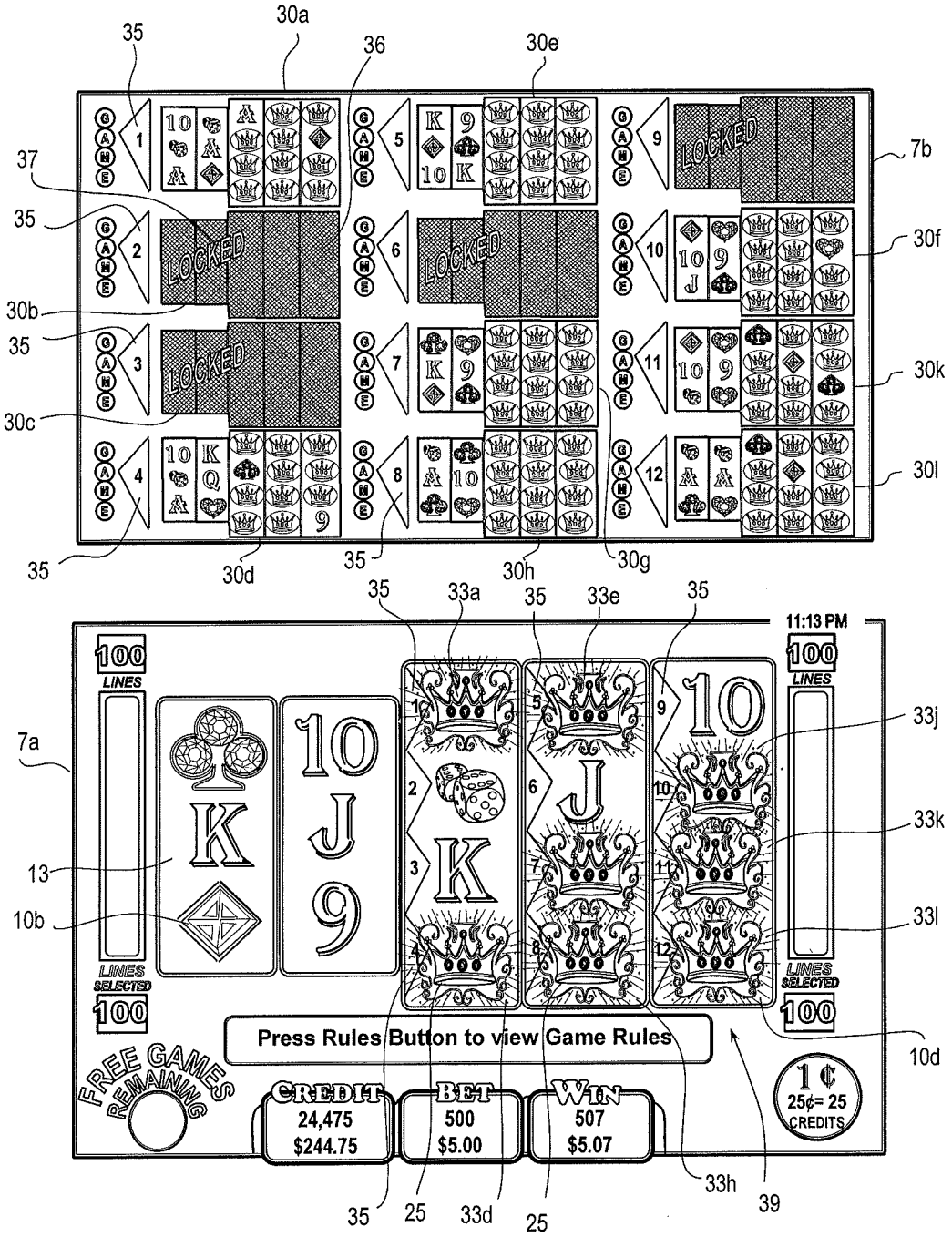

FIG. 7 shows another subsequent spin in the sequence of free spins or plays of the feature game 9, where corresponding features have been given the same reference numerals. In this spin, a neon crown symbol 25 has appeared in designated cell 33*k* to cause its associated secondary array 30*k* to become available for play simultaneously with the primary array 11. Previous spins of the feature game 9 have activated or made available secondary arrays 30*a*, 30*d*, 30*e*, 30*g*, 30*h*, 30*j* and 30*l*. Since the appearance of the neon crown symbol 25 in designated cell 33*k* is accompanied by suitable sounds and animation, the player is able to recognize when a new or fresh neon crown symbol 25 has appeared on the sub-array 39 and distinguish any new neon crown symbols 25 from the neon crown symbols 25 that already appear on the sub-array 39.

Figure 8:
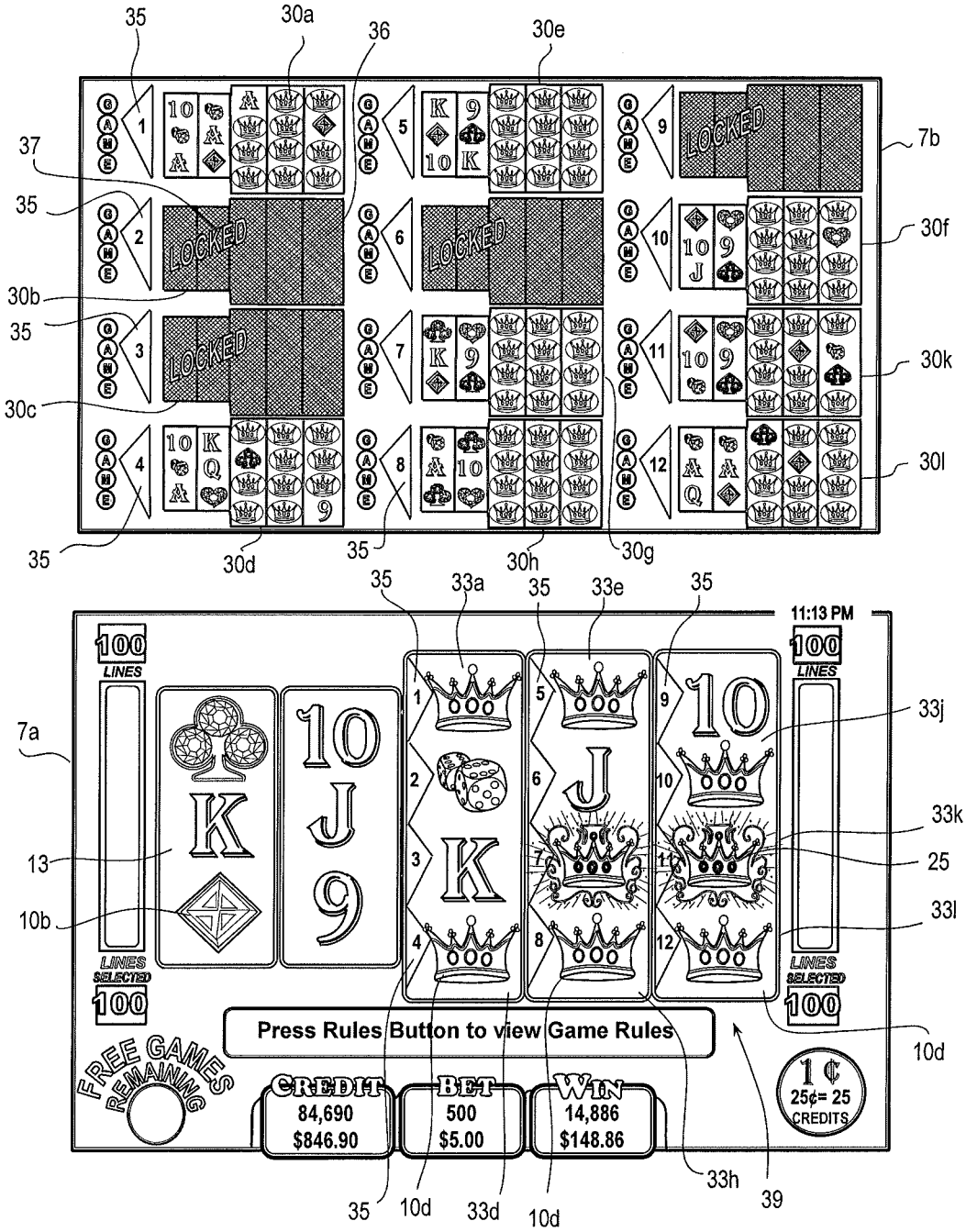

Referring to FIG. 8, another embodiment of the invention is illustrated, where corresponding features have been given the same reference numerals. In this embodiment, the neon crown symbols 25 are replaced after the spin in which they first appear by substitute or wild card crown symbols 10*d*. To better illustrate this alternate embodiment, the primary array 11 and secondary arrays 30 are substantially the same as those illustrated in FIG. 7. Again, a neon crown symbol 25 has appeared in designated cell 33*k* to cause its associated secondary array 30*k* to become available for play simultaneously with the primary array 11. Previous spins of the feature game 9 have activated or made available secondary arrays 30*a*, 30*d*, 30*e*, 30*g*, 30*h*, 30*j* and 30*l*. Unlike FIG. 7 and the other embodiments described above, the designated cells 33*a*, 33*d*, 33*e*, 33*g*, 33*h*, 33*j* and 33*l* corresponding to the previously activated secondary arrays 30*a*, 30*d*, 30*e*, 30*g*, 30*h*, 30*j* and 30*l* display crown symbol 10*d* instead of the neon crown symbol 25 for their respective subsequent spins or plays. This is done to highlight the appearance of new neon crown symbols 35 appearing in designated cells 33 on the sub-array 39 for the current spin or play of the feature game 9. Since the neon crown symbols 25 also act as substitute symbols, there is no change in the possible combinations of symbols that can be obtained on the primary array 11 and secondary arrays 30 by replacing the neon crown symbols 25 with substitute crown symbols 10*d* for subsequent spins or plays after the initial appearance of the neon crown symbols.

The electronic game controller 4 may randomly select the predetermined position or cell 13, including designated cells 33, for the neon crown symbols 25 from the available cells 13 in the primary array 11. Alternatively, the electronic game controller 4 may select the predetermined position or cell 13, including designated cells 33, for the neon crown symbols 25 according to a predetermined order, which would comprise a specific sequence of cells 13 from the array 11.

In addition, in the embodiment the electronic game controller 4 selects the cells 13 for the neon crown symbols 25 before the start or commencement of each spin or play of the feature game. Furthermore, the game symbols 10 are displayed sequentially on a reel by reel basis so that the symbols are gradually displayed on the array 11. Also, the neon crown symbols 25 appear in unique cells 13 in the primary array 11 and do not appear in addition to the cells 13 or share a cell with another game symbol 10 or special symbol 25.

It thus can be seen that as special neon crown symbols 25 appear in the designated cells 33 on the sub-array 39, the secondary arrays 30 become available to the player for play simultaneously with the primary array 11, thus increasing the probability of a predetermined winning combination of game symbols 10 appearing on the primary array 11 or an available secondary array 30 and hence a prize being awarded to the player. The addition of a multiplier effect to the appearance of the neon crown symbols 25 further increases the value of the awarded prize. Consequently, once the player sees the neon crown symbols 25 appear on the primary array 11, his or her anticipation is heightened as he or she will recognize that the neon crown symbols permit access to the secondary arrays 30 until the feature game ends. Also, the player is assured that the secondary arrays 30 remain available for subsequent spins or plays of the feature game. Thus, there is no risk of building a substantial number of available secondary arrays 30 that are partly or fully lost in the next play that resets the secondary arrays 30. All these factors increase the player's excitement and interest in the game played on the electronic gaming machine 1.

While the preferred embodiments have described the special symbols 25 as being displayed in the same designated cell 33 for each subsequent play of the feature game 9, in other embodiments, the special symbols 25 are displayed in the same designated cell 33 for one or some subsequent plays, and then move to a different designated cell or cells for the remaining subsequent plays, to create variety in game play. This may result in their associated secondary arrays 30 becoming available and unavailable for different spins or plays in the feature game 9, but not decreasing the total number of available secondary arrays. That is, while a particular secondary array 30 may not be available for all subsequent plays of the feature game 9 once activated, the number of available secondary arrays 30 would at least stay the same if no further neon crown symbols 25 appear in the designated cells 33 to trigger a fresh secondary array 30.

While the neon crown symbols 25 has been described as having a triple effect of being a trigger symbol, special symbol and substitute symbol, it will be appreciated that the special symbol 25 can act as a scatter symbol, jackpot symbol, a symbol that reveals another symbol or any other game symbol 10. The neon crown symbols 25 could also change into a completely new symbol different to the other game symbols, the new symbol conferring a game enhancing element such as a bonus prize or free games.

The electronic game controller 4 randomly determines the appearance of the trigger symbols in the base game 8 that activate the feature game 9. However, it will be appreciated that this determination need not be totally random as the electronic game controller 4 may switch to a reel strip having a greater probability of the neon crown symbol 25 appearing where the feature game 9 has not be triggered for a predetermined number of plays of the base game 8.

In other preferred forms, for each successive play the electronic game controller 4 randomly selects the predetermined position of each additional special symbol to be displayed in each said subsequent play and randomly reselects the predetermined game position of each special symbol previously displayed in a preceding play. This introduces some randomness into the appearance of the special symbols on the primary array 11 for each successive play or spin of the feature game 9 and increases the rate at which the secondary arrays 30 are made available to the player during the feature game without reducing the number of special symbols displayed in each successive play.

In another preferred form, the individual cells 13, including designated cells 33, each represent a single "reel" so that the primary array 11 has 21 separate reels instead of 5 reels. In this case, the invention would function in the same way, with the electronic game controller 4 selecting designated reels instead of designated cells 33 for displaying special symbols 25 that cause the activation of the secondary arrays 30. The secondary arrays 30 may also have individual cells 13 that represent a single reel so that each secondary array 30 has 21 separate reels.

Figure 9:
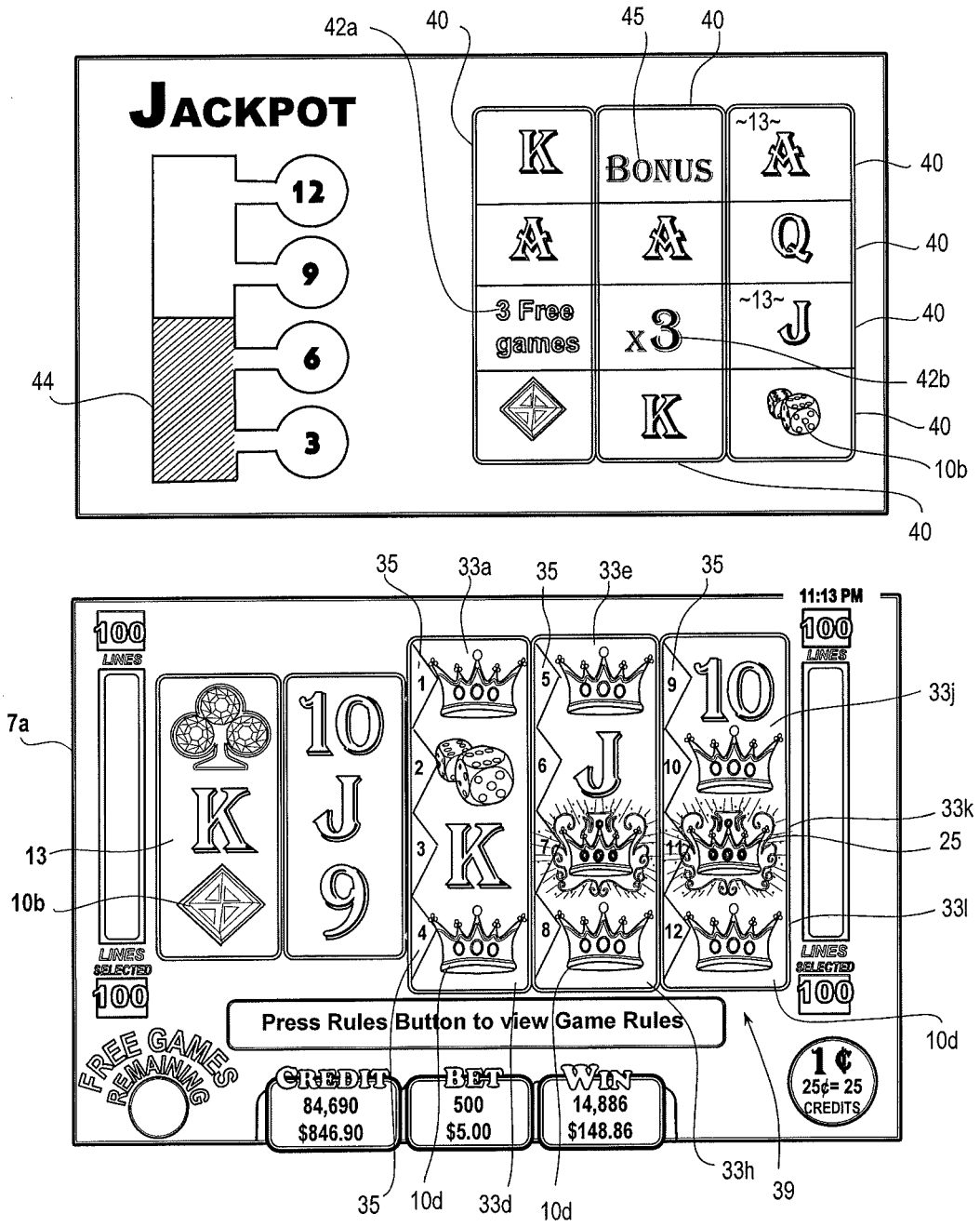
FIG. 9 is a schematic drawing illustrating an alternative embodiment of a feature game for the base game of FIG. 3.

A further preferred form is illustrated in FIG. 9, where corresponding features have been given the same reference numerals. In this embodiment, the secondary arrays 40 each comprise individual cells 13 that act as single reels, so that there are twelve separate reels 40 respectively associated with the designated cells 33 in the primary array 11. The reels 40 display game symbols 10 and game enhancing symbols 42 that confer associated game enhancing elements, such the 3 free games symbol 42*a* that awards three additional free spins or plays of the feature game 9 and the ×3 multiplier symbol 42*b* that triples the values of any awarded prizes. In this embodiment, there may also be an associated bonus point meter 44, where special bonus or collector symbols 45 appearing in the secondary arrays 40 are accumulated by the player and visually recorded by the bonus point meter 44. When predetermined member of bonus points or symbols 45 are collected, the player earns a jackpot prize that gradually increases as the number of bonus symbols are collected. Once the feature game 9 ends, then a jackpot prize is awarded based on the number of bonus symbols 45 collected in the feature game. As shown in FIG. 9, six bonus symbols 45 have been collected and if no more bonus symbols are collected, then the player will receive a mid-value jackpot, greater than a minimum jackpot prize for only three bonus symbols but less than a maximum jackpot prize for twelve bonus symbols.

Also, while the subsequent plays of the feature game 9 have been described as being successive or consecutive plays, it will be appreciated that the subsequent plays need not follow one after another, but can be separated from each other or occur in bunches or groups to add an element of randomness into the game. This may be useful where there are more subsequent plays than designated cells 33 in the sub-array 39. However, it will be appreciated that in further preferred forms of the invention the number of secondary arrays 30 is equal to the number of cells 13 in the primary array 11 so that each cell 13 is a designated cell 33 that can activate or make available a corresponding secondary array 30 to the player.

Also, in an alternative embodiment, the available secondary arrays 30 are made available for play simultaneously with the primary array 11 for one or more subsequent plays of the feature game. That is, any secondary arrays 30 activated by in a particular play are not available until the next or subsequent play of the feature game 9.

Aside from applying the invention to a feature game only, as described in the preferred embodiment, it will be appreciated that the invention may be applied to a base game or a combination of a base game and a feature game offered on the electronic gaming machine 1. In the case of a base game only, the invention would work in substantially the same manner as described above. However, the player may be required to make a bet for each successive play. In the case of applying the invention both the base game and a feature game, the special symbols 25 that first appear to trigger the feature game 9 would activate or make available the associated secondary arrays 30 simultaneously with the primary array 11 for the play of the feature game.

In the preferred embodiments, the feature game 9 employs the same primary array 11 as the base game 8, as well as the same game symbols 10 that are used in the base game. However, it will be appreciated that the main array and secondary arrays for the feature game 9 may vary from the base game. For example, the feature game 9 could adopt a different format of cells and/or use an entirely different set of game symbols, or a mixture of game symbols from the base game and different game symbols.

While the electronic gaming machine 1 has two video display screens 7*a*, 7*b*, in other embodiments the electronic gaming machine 1 only has one video display screen 7 and the primary array 11 and secondary arrays 30 of the feature game 9 may be shown on the one screen.

In other preferred forms, the game has other features like jackpot prizes. The jackpot prize can be shared with any other games offered on the electronic gaming machine (as in multi-game gaming machines) or games offered on separate electronic gaming machines. Information relating to the jackpot prize(s) can be provided on the display screen 7 or via another screen that is devoted to displaying jackpot information. In one preferred form, the jackpot prize comprises a mystery jackpot. That is, none of the symbols in the game trigger the jackpot; hence the triggering event is a "mystery". By way of comparison, a standard jackpot is typically symbol driven in that a particular combination of symbols must occur in the game to trigger the standard jackpot.

Also, in a further preferred form, the player can selectively stop spinning of the reels 12 to increase player interaction. Furthermore, the player can start spinning of the reels 12 to further enhance player interaction.

In the preferred embodiments, the video display screens 7*a*, 7*b* are touch screen for use in addition to the player-actuatable buttons 6. This enables the player to select various features, such as responding to any messages or requests issued on the electronic gaming machine 1 by the electronic game controller 4. In this case, the player may control when the reels 12 start spinning and stop spinning in the base game 8 or feature game 9 by simply touching the relevant reel 12.

It will be appreciated that while the preferred embodiments have been described in relation to an industry standard electronic gaming machine, the invention can be readily applied to other types of electronic gaming machines, including a personal computer (standing alone or connected to a communications network, LAN or WAN), mobile electronic devices (such as handheld or portable electronic devices like tablets and smart phones) and other electronic devices capable of displaying a game. In each of these machines, there is a visual display with an electronic game controller in the form of a processor or central processing unit. In the case of mobile electronic devices, in one arrangement the mobile electronic device may permit the player to make bets using "virtual" credits that represent a monetary value, but do not require the player to make a monetary transaction. Instead, the invention may provide a tiered access to the various features of the game so that the player can make relatively small payments to access particular features of the game or obtain additional benefits during game play. An alternative arrangement would require the player to purchase virtual credits or tokens via an interface on the mobile electronic device or an online interface accessible by the mobile electronic device. A further arrangement would not require any monetary transaction at all. Similarly, the above described arrangements can be applied where the invention is implemented on a personal computer (PC) connected to the internet (wirelessly or not). In one example of the implementation, the PC would access an online casino over the internet to play the game of the invention or the game of the invention would be part of a social networking website. It is also contemplated that the player could also make regular payments to subscribe to continue playing the game on the mobile electronic device, PC or other electronic device.

In an alternative embodiment, the electronic gaming machine also provides an option for the player to play with either credits based on a monetary amount or virtual credits as discussed above. This can be implemented by way of a selection menu prior to playing the selected game or by providing a suitable menu button on screen during play of the selected game.

In another aspect, the invention includes a computer program configured to perform the invention. In this way the invention can be implemented in various ways on an electronic gaming machine. In a further aspect, the invention includes a computer system comprising a central processing unit configured for communication with an electronic gaming machine to perform the invention. In a yet another aspect, the invention includes a non-transitory carrier medium carrying computer executable code that, when executed on a central processing unit configured for communication with an electronic gaming machine, causes said central processing unit to perform the invention. In this case, the non-transitory carrier medium includes an external hard drive, a memory device, including a memory card, smart card, a radio frequency identification (RFID) device, USB key, magnetic card or other electronic storage device.

It will further be appreciated that any of the features in the preferred embodiments of the invention can be combined together and are not necessarily applied in isolation from each other. For example, the random selection of designated cells 33 for displaying the special symbols 25 for each successive or subsequent play can be combined with the provision of a separate trigger symbol other than the special symbol 25 in the base game 8 for triggering the feature game 9.

By providing secondary arrays associated with designated positions in a primary array that are made available or activated for simultaneous play with the primary array via the appearance of special symbols in those designated positions, the invention increases the player's excitement in the game and heightens his or her anticipation of a prize due to the increase probability of a winning combination appearing in either the primary array or any of the available secondary arrays. Additional advantages are conferred by providing a multiplier effect to the special symbols, retaining the special symbols in the designated positions for subsequent plays and keeping the available secondary arrays for the duration of the game further increase player interest and encourages the player to continue playing the same electronic gaming machine. Furthermore, since the electronic game controller controls operation of the electronic gaming machine, the invention can be readily implemented to existing gaming machines and other gaming systems. In all these respects, the invention represents a practical and commercially significant improvement over the prior art.

Although the invention has been described with reference to specific examples, it will be appreciated by those skilled in the art that the invention may be embodied in many other forms.

The invention claimed is:

1. An electronic gaming machine comprising:

a display for displaying a plurality of game arrays of game symbols, vending slots for receiving monetary bets, and an electronic game controller adapted to determine if a bet has been made using the vending slots to initiate play, and, if a bet has been made, to randomly select said game symbols, to control the display of said game symbols on said display and to award prizes where predetermined winning combinations of game symbols appear in the plurality of game arrays, wherein said game arrays comprise a first game array and at least a second game array and a third game array, said first game array, said second game array and said third game array each comprising a plurality of predetermined positions for displaying said randomly selected game symbols, said electronic game controller fixedly associating said second game array with a first single fixed predetermined position of said predetermined positions on said first game array, and said third game array with a second single fixed predetermined position of said predetermined positions on said first game array, said electronic game controller determining an appearance of one or more special symbols in said predetermined positions on said first game array, the appearance of any special symbol in said first single fixed predetermined position in a play of a game on said first game array causes said electronic game controller to make the second game array associated with said first single fixed predetermined position available to said player for play simultaneously with said first game array, and the appearance of any special symbol in said second single fixed predetermined position in the play of the game on said first game array causes said electronic game controller to make the third game array associated with said second single fixed predetermined position available to said player for play simultaneously with said first game array.

2. The electronic gaming machine of claim 1, wherein said electronic game controller arranges said second and third game arrays in a group such that a first position of said second game array in said group corresponds to a first location of said first single fixed predetermined position on said first game array and a second position of said third game array in said group corresponds to a second location of said second single fixed predetermined position on said first game array.

3. The electronic gaming machine of claim 1, wherein said first game array includes more than said first and second single fixed predetermined positions.

4. The electronic gaming machine of claim 1, wherein said second and third game arrays are playable simultaneously with said first game array for said play.

5. The electronic gaming machine of claim 1, wherein said second and third game arrays are playable simultaneously with said first game array for one or more subsequent plays of said game.

6. The electronic gaming machine of claim 5, wherein said special symbol occupies said first and/or second single fixed predetermined positions for said one or more subsequent plays.

7. The electronic gaming machine of claim 1, wherein said special symbol confers a gaming enhancing element on said first game array, said second game array and/or said third game array.

8. The electronic gaming machine of claim 7, wherein said gaming enhancing element increases a value of any prizes awarded by said first game array, said second game array and/or said third game array.

9. The electronic gaming machine of claim 8, wherein said gaming enhancing element comprises a numerical value and increases in the value are associated with said numerical value.

10. The electronic gaming machine of claim 9, wherein said numerical value increases the value by multiplying the value of any prizes by said numerical value.

11. The electronic gaming machine of claim 10, wherein said numerical value is equal to a number of special symbols appearing in said fixed predetermined positions on said first game array.

12. The electronic gaming machine of claim 1, wherein said first game array comprises an array of rows and columns of said predetermined positions, and said first and second single fixed predetermined positions are arranged as a part of a sub-array of said first game array, said sub-array comprising rows and/or columns of fixed predetermined positions.

13. The electronic gaming machine of claim 12, wherein said rows and/or columns of said sub-array are different to the rows and/or columns of remaining parts of said first game array.

14. The electronic gaming machine of claim 13, wherein said sub-array comprises four rows and three columns and said remaining parts comprise three rows and two columns.

15. A gaming method for playing an electronic gaming machine comprising a display, vending slots to receive monetary bets, and an electronic game controller, the method comprising the steps of:

determining if a bet has been made using the vending slots to initiate play;

if a bet has been made, randomly selecting said game symbols and controllably displaying a plurality of game arrays on said display, said game arrays comprising a first game array and at least a second game array and a third game array, said first game array, said second game array and said third game array each comprising a plurality of predetermined positions for displaying said randomly selected game symbols;

fixedly associating said second game array with a first single fixed predetermined position of said predetermined positions on said first game array, and said third game array with a second single fixed predetermined position of said predetermined positions on said first game array;

controllably displaying said randomly selected game symbols in said predetermined game positions on said game arrays, awarding prizes to a player where predetermined winning combinations of said randomly selected game symbols appear in the first game array, in response to an appearance of any special symbol in said first single fixed predetermined position in a play of a game on said first game array, causing said second game array associated with said first single fixed predetermined position to become available to said player for play simultaneously with said first game array, and in response to an appearance of any special symbol in said second single fixed predetermined position in the play of the game on said first game array, causing said third game array associated with said second single fixed predetermined position to become available to said player for play simultaneously with said first game array.

16. The method of claim 15, further comprising arranging said second and third game arrays into a group such that a first position of said second game array in said group corresponds to a first location of said first single fixed predetermined position on said first game array and a second position of said third game array in said group corresponds to a second location of said second single fixed predetermined position on said first game array.

17. The method of claim 15, wherein said first game array includes more than said first and second single fixed predetermined positions.

18. The method of claim 15, further comprising making said second and third game arrays playable simultaneously with said first game array for said play.

19. The method of claim 15, further comprising making said second and third game arrays playable simultaneously with said first game array for one or more subsequent plays of said game.

20. The method of claim 19, further comprising displaying said special symbol in said first and/or second single fixed predetermined positions for said one or more subsequent plays.

21. The method of claim 15, further comprising conferring a gaming enhancing element on said first game array, said second game array and/or said third game array in response to said appearance of said special symbol.

22. The method of claim 21, wherein said conferring step comprises increasing a value of any prizes awarded by said first game array, said second game array and/or said third game array.

23. The method of claim 22, wherein said gaming enhancing element comprises a numerical value and said increasing step is associated with said numerical value.

24. The method of claim 23, wherein said increasing step comprises multiplying the value of any prizes by said numerical value.

25. The method of claim 23, wherein said numerical value is equal to a number of special symbols appearing in said fixed predetermined positions on said first game array.

26. The method of claim 15, wherein said first game array comprises rows and/or columns of said predetermined positions, further comprising arranging said first and second single fixed predetermined positions into a part of a sub-array of said first game array, said sub-array comprising rows and/or columns of fixed predetermined positions.

27. The method of claim 26, wherein said arranging step comprises arranging said rows and/or columns of said sub-array to be different to the rows and/or columns of remaining parts of said first game array.

28. The method of claim 27, wherein said sub-array comprises four rows and three columns and said remaining parts comprise three rows and two columns.

* * * * *